US009889685B2

(12) United States Patent
Koop

(10) Patent No.: US 9,889,685 B2
(45) Date of Patent: Feb. 13, 2018

(54) METHOD TO EXCHANGE PRINTING SUBSTRATE ROLLS IN A PRINTER

(71) Applicant: Oce Printing Systems GmbH & Co. KG, Poing (DE)

(72) Inventor: Raimund Koop, Lengdorf (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/089,982

(22) Filed: Apr. 4, 2016

(65) Prior Publication Data

US 2016/0297216 A1 Oct. 13, 2016

(30) Foreign Application Priority Data

Apr. 8, 2015 (DE) ..... 10 2015 105 294

(51) Int. Cl.

| | |
|---|---|
| ***B41J 15/04*** | (2006.01) |
| ***B41J 15/02*** | (2006.01) |
| ***B41J 15/18*** | (2006.01) |
| ***B41J 15/16*** | (2006.01) |

(52) U.S. Cl.

CPC ..... *B41J 15/042* (2013.01); *B41J 15/02* (2013.01); *B41J 15/04* (2013.01); *B41J 15/16* (2013.01); *B41J 15/18* (2013.01)

(58) Field of Classification Search

CPC . B41J 15/042; B41J 15/18; B41J 15/02; B41J 15/16; B41J 15/04

See application file for complete search history.

(56) References Cited

U.S. PATENT DOCUMENTS

| | | | | |
|---|---|---|---|---|
| 9,415,624 | B1 * | 8/2016 | Bedinghaus | B42F 17/18 |
| 2008/0169057 | A1 * | 7/2008 | Halbrook | B65H 18/28 156/159 |
| 2011/0279508 | A1 * | 11/2011 | Naito | B41J 15/04 347/16 |

* cited by examiner

*Primary Examiner* — Geoffrey Mruk
(74) *Attorney, Agent, or Firm* — Schiff Hardin LLP

(57) ABSTRACT

Methods to exchange printing substrate rolls in a printer are described. In an exchange method, ink is printed to a first printing substrate web being unwound from a first printing substrate roll. The first printing substrate web is exchanged with a second printing substrate web being unwound from a second printing substrate roll. A transition region of the first and the second printing substrate webs is printed to during the exchange of the first and the second printing substrate webs. The transition region can be formed by gluing the second and the first printing substrate webs atop one another. A predetermined pattern can be printed onto the transition region during the exchange of the printing substrate rolls. The predetermined pattern can be chosen such that all nozzles of at least one print head are used for printing.

17 Claims, 1 Drawing Sheet

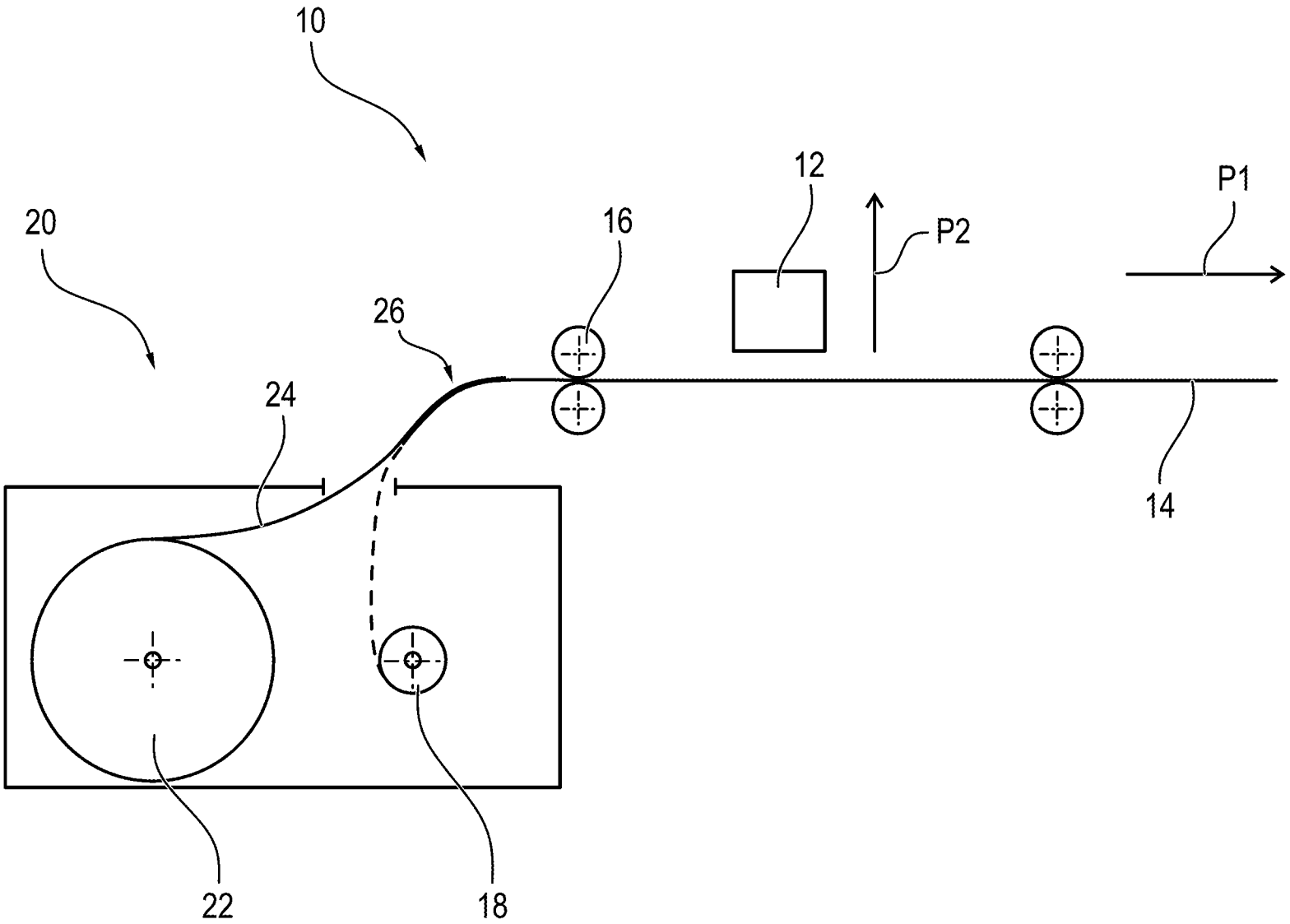
10
20
12
16
26
24
P1
P2
14
18
22

METHOD TO EXCHANGE PRINTING SUBSTRATE ROLLS IN A PRINTER

CROSS REFERENCE TO RELATED APPLICATIONS

This patent application claims priority to German Patent Application No. 102015105294.6, filed Apr. 8, 2015, which is incorporated herein by reference in its entirety.

BACKGROUND

The disclosure concerns a method to exchange printing substrate rolls in a printer in which a first printing substrate web unwound from a first printing substrate roll is printed to with ink with the aid of at least one print head, and in which the first printing substrate roll is exchanged for a second printing substrate roll.

In high-capacity inkjet printers, printing substrate webs, in particular paper webs, unwound from printing substrate rolls are often printed to with ink via the printer. The printing substrate rolls must hereby inevitably be exchanged regularly, at the least when the printing substrate supply runs out. During the exchange of the printing substrate rolls, the printing is typically stopped, meaning that no ink is ejected from the nozzles of the print head during the exchange. It is problematic with this that, in particular in areas with a warm, dry climate, the print heads may dry up very quickly if no printing takes place. This has the consequence that individual nozzles may plug if the exchange of the printing substrate rolls takes too long, and a high-quality print image is thus no longer possible.

A known method to avoid this problem is that a cleaning process of the print heads is first executed in order to remove dried ink after the exchange of the printing substrate roll, before the actual printing operation is begun again. However, this is disadvantageous in that it is linked with an additional cost, and the downtime of the printer is hereby increased.

U.S. Pat. No. 4,970,527 describes a printer with a microcontroller with the aid of which the time that has passed since the last utilization of the print head is determined. If a preset threshold of no printing is exceeded, a predetermined quantity of ink is ejected from all nozzles of the print head in order to prevent a drying.

U.S. Pat. No. 6,619,784 describes a method in which it is determined when ink containing colorant has accumulated in the region of the nozzles. In this case, this ink is printed onto the printing substrate in a region outside of the actual print region.

EP 1 223 134 A2 describes an on-the-fly roll exchange in a printer, meaning that one printing substrate roll is replaced with another printing substrate roll without the printer needing to be stopped for this. Even given such exchanges of rolls on the fly, it is customary to not print during the exchange, meaning that no printing takes place while that region in which the two printing substrate webs are glued to one another is directed past the print head.

A method for exchanging printing substrate rolls in a printer is known from the document WO 2007/114813 A1, in which method the print job continues to be printed in the transition region between the printing substrate rolls.

Additional methods to exchange printing substrate rolls in a printer, and corresponding printers, are known from the documents US 2014/0035982 A1, JP 2012/153150 A and JP 2012/166557 A.

BRIEF DESCRIPTION OF THE DRAWINGS/FIGURES

The accompanying drawing, which is incorporated herein and form a part of the specification, illustrates the embodiments of the present disclosure and, together with the description, further serve to explain the principles of the embodiments and to enable a person skilled in the pertinent art to make and use the embodiments.

FIG. 1 illustrates a schematic depiction of a printer with an autosplicer according to exemplary embodiments of the present disclosure.

The exemplary embodiments of the present disclosure will be described with reference to the accompanying drawing.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

It is an object of the disclosure to describe a method for exchanging printing substrate rolls in a printer, with the aid of which method the exchange may be executed as simply and efficiently as possible without the print quality being degraded.

According to exemplary embodiments of the disclosure, ink continues to be ejected without interruption from the nozzles of the printing substrate webs during the exchange of the printing substrate rolls, and thus during the exchange of the printing substrate webs unrolled from the printing substrate rolls. In exemplary embodiments, ink is prevented from drying up, and thus that printing may be continued according to plan immediately after the exchange of the printing substrate webs, without a preceding cleaning of the print head. The time in which the printer cannot print according to plan (i.e., the desired print image cannot be printed onto the printing substrate web) is reduced and/or minimized, thereby resulting in an increased productivity. Further, downtime and cleaning costs are reduced by saving on the cleaning process. Moreover, a high print quality is ensured, whereby the drying up of ink is reduced and/or avoided.

In exemplary embodiments, with the uninterrupted ejection of ink from the nozzles of the print head during the exchange of the printing substrate rolls, printing is continued with the same process speed as in regular printing to the printing substrate web before the exchange.

In an exemplary embodiment, an exchange of the first printing substrate web for the second printing substrate web is implemented on the fly. For example, the second printing substrate web of the second printing substrate roll can be glued to the printing substrate web of the first printing substrate roll in the region of a gluing area during the regular operation of the printer (thus while the first printing substrate web of the first printing substrate roll is still being printed to), such that printing may be continued without stopping the printer. When the printing substrate web of the first printing substrate roll is "used up," the printing substrate web of the second printing substrate roll is automatically guided through the printer insofar as the printing substrate web of the second roll is glued to the printing substrate web of the first roll.

In an exemplary embodiment, the exchange of the two printing substrate rolls for one another in particular takes place with the aid of an autosplicer.

A particularly high efficiency is hereby achieved since the printer does not need to first be stopped and started up again.

In an exemplary embodiment, during the exchange of the two printing substrate webs, the two printing substrate webs of the printing substrate rolls are glued to one another in a gluing area and are also printed to such that the ink flow through the nozzles is not interrupted.

In an exemplary embodiment, a portion or all of the transition region between the actual print images to be applied continues to be printed to with one or more predetermined patterns. Given an on-the-fly exchange of the printing substrate rolls, a region before and after the gluing area via which the printing substrate webs are glued together is not used for printing with the actual print image. Rather, the printing with the actual print image is interrupted until this transition region has been transported past the print heads, and only then does a printing with the actual print image take place again. In order to prevent the ink from drying up, this entire transition region is printed to with one or more predetermined patterns. In particular, the transition region can be printed to over its entire area. In an exemplary embodiment, nozzles of the print heads that have previously been used comparatively less or not at all for a longer period of time during the regular print operation are used for printing in the transition region.

In an exemplary embodiment, refresh lines are continuously printed as a preset pattern. For example, the preset pattern is chosen such that all nozzles of the print head are required for printing the pattern, such that the drying of all nozzles is prevented. The preset patterns can be chosen such that all nozzles of all print heads are required for printing this pattern, such that all nozzles are saved from drying up. For this, the pattern in particular includes all print colors.

In an exemplary embodiment of the disclosure, at the beginning of the exchange of the printing substrate rolls, the clearance of the print head from the printing substrate web is increased in comparison to the clearance that it has from the printing substrate web during the regular print operation. As a result, the printing substrate web does not contact the print head and thus the print head cannot be damaged.

During the on-the-fly exchange of the printing substrate web, it may occur that the printing substrate web is not guided as smoothly as during the regular print operation. Moreover, the printing substrate web is thicker in its formation (at least in the region of the gluing area) due to the gluing of the printing substrate webs of the two printing substrate rolls together, such that the danger of damage exists without an increase of the clearance.

After ending the exchange of the printing substrate rolls, the clearance of the print head from the printing substrate web can be reduced so that the regular print operation may be continued. In an exemplary embodiment, the clearance is reduced when the gluing area (and thus the transition region between the two printing substrate webs) has been directed past the print head.

In an exemplary embodiment, the regular print operation is when the printer is operating to print the print image to the printing substrate. During substrate exchange, the printer is operating in what can be referred to as refresh print operations, splicing print operation, and/or a transition printing operation. In the refresh/splicing/transition operations, the predetermined pattern is printed to the transition region to prevent drying of the print heads.

In FIG. 1, a schematic, significantly simplified depiction of an inkjet printer 10 is shown according to exemplary embodiments of the present disclosure. In an exemplary embodiment, the printer 10 comprises a print head 12 configured to print ink to a printing substrate web 14. In operation, the printing substrate web 14 is transported, with the aid of one or more transport elements 16, past the print head 12 in a transport direction P1. During the regular print operation (i.e., during the printing to the printing substrate web 14 with the print image), ink droplets are ejected from the nozzles of the print head 12 corresponding to the desired print image.

The transport elements 16 may in particular be roller pairs between which the printing substrate web 14 is directed and that are driven accordingly so that the printing substrate web 14 is also transported in the direction of the transport direction P1.

The printing substrate web 14 is hereby unwound from a printing substrate roll 18.

In an exemplary embodiment, the printer 10 includes an autosplicer 20. The autosplicer 20 can be configured to adjoin (e.g. glue) the second printing substrate web 24 of a second printing substrate roll 22 onto the first printing substrate web 14 of the first printing substrate roll 18 in a transition region 26 so that they overlap one another. In other embodiments, the autosplicer 20 can be configured to glue the first printing substrate web 14 onto to the second printing substrate web 24. The gluing of the printing substrate webs 14 and 24 together can be performed during the operation of the printer 10. In an exemplary embodiment, the gluing can be performed before the first printing substrate web 14 rolled up on the first printing substrate roll 18 has been completely unrolled, such that an exchange on the fly is possible. This state is shown in FIG. 1. In this example, the printer 10 thus does not need to be stopped to exchange the printing substrate rolls 18, 20, which ensures a particularly high productivity and reduces downtimes. In an exemplary embodiment, the autosplicer 20 can include one or more controllers and/or processors configured to control the operation of the autosplicer 20.

In an exemplary embodiment, printing via the print head 12 is continued (i.e., ink continues to be ejected from the nozzles onto the printing substrate web 14, 24) during the exchange of the printing substrate rolls 18, 22, in particular while the transition region 26 of the printing substrate webs 14, 24 is transported past the print head 12. In an exemplary embodiment, one or more predetermined patterns (for example, refresh lines) are printed onto the transition region 26 of the of the printing substrate webs 14, 24 via the print head 12 during the exchange, since this transition region 26 is not required for the final print job and is cut away.

Via this continued printing via the print head 12, the drying up of the ink in the print head 12 is reduced and/or avoided (thereby reducing/avoiding the plugging of nozzles and to quality losses of the print image). This drying would typically result given typical interruption of the printing during the exchange.

In an exemplary embodiment, the full effectiveness of the on-the-fly exchange of the printing substrate rolls 18, 22 via the autosplicer 20 may be utilized since the actual "regular" print operation may be continued again immediately after the transition region 26 of the printing substrate webs 14, 24 has been transported past the print head 12, and a cleaning process of the print head 12 to remove dried ink does not need to be implemented before such continuation of printing (as is otherwise customary).

In an exemplary embodiment, the entire exchange of the printing substrate rolls 18, 22 may thus take place at full process speed.

In an exemplary embodiment, the print head 12 is moved away from the printing substrate web 14, 24 in the direction of the arrow P2 during the exchange of the printing substrate rolls 18, 22 (while the transition region 26 of the printing substrate webs 14, 24 is being transported past the print head 12), such that the clearance from the printing substrate web 14, 24 is increased during the exchange. In this example, contact between the printing substrate webs 14, 24 and the print head 12 can be avoided which could damage the print head 12 and/or the printing substrate web 14, 24. Further, the larger clearance of the print head 12 from the printing substrate web 14, 24 does not affect the print quality of the print job as this clearance is only found during the printing of the refresh lines to maintain the ink flow, which do not have the quality requirements of the normal printing process.

In an exemplary embodiment, the printer 10 comprises multiple print heads 12. In this example, one or more of the print heads can print refresh lines on the transition region 26 so that the drying of the print heads 12 is avoided. In an exemplary embodiment, all print heads 12 print refresh lines on the transition region.

In an exemplary embodiment, the printer 10 comprises up to six print bars that respectively have four to six print heads 12, wherein a print bar respectively prints a line transversal to the transport direction P1. The pattern that is printed onto the transition region 26 can be chosen such that all print heads 12—and in particular all nozzles of all print heads 12—are required to print to the pattern, such that none of the nozzle dry up.

In an exemplary embodiment, the printer 10 comprises a controller configured to control the overall operation of the printer 10, including the operation of one or more components of the printer 10. The controller can be configured to, for example, control the print heads 12 to perform their corresponding printing operations, control the autosplicer 20 to adjoin the printing substrate webs 14, 24 to exchange printing substrate rolls 18, 22, and/or adjust the position of the print heads 12 with respect to the printing substrate webs 14, 24.

In an exemplary embodiment, the controller includes processor circuitry configured to perform the various functions of the controller. In an exemplary embodiment, the processor circuitry includes one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein. Memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable or removable.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc.

Further, any of the implementation variations may be carried out by a general purpose computer.

REFERENCE LIST

10 printer
12 print head
14, 24 print web
16 transport element
18, 22 printing substrate roll
20 autosplicer
26 transition region
P1, P2 direction

What is claimed is:

1. A method to exchange printing substrate rolls in a printer, the method comprising:

printing, using at least one print head, ink to a first printing substrate web being unwound from a first printing substrate roll;

exchanging the first printing substrate web with a second printing substrate web being unwound from a second printing substrate roll; and printing, using the at least one print head, to a transition region of the first and the second printing substrate webs during the exchange of the first and the second printing substrate webs, the transition region being formed by gluing the second and the first printing substrate webs atop one another, wherein:

a predetermined pattern is printed onto the transition region of the first and the second printing substrate webs during the exchange of the printing substrate rolls, the predetermined pattern being chosen such that all nozzles of the at least one print head are operated to print the predetermined pattern, and a clearance of the at least one print head from the first printing substrate web is increased before the transition region is transported past the at least one print head.

2. The method according to claim 1, wherein printing during the exchange of the first printing substrate roll with the second printing substrate roll is continued with a same process speed as in the printing to the first printing substrate web before the exchange.

3. The method according to claim 1, wherein, during the exchange of the first printing substrate roll with the second printing substrate roll, the first and the second printing substrate webs are transported through the printer with a lower speed in comparison to a process speed at which the printing to the first printing substrate web before the exchange is performed.

4. The method according to claim 1, wherein an exchange of the first printing substrate roll with the second printing substrate roll is implemented on the fly.

5. The method according to claim 1, wherein a start of the second printing substrate web of the second printing substrate roll is glued overlapping with an end of the first printing substrate web via a gluing area during a regular operation of the printer to form the transition region.

6. The method according claim 1, wherein the clearance of the at least one print head is reduced after the transition region has been transported past the at least one print head.

7. The method according to claim 1, wherein the predetermined pattern is a pattern of refresh lines.

8. The method according to claim 1, wherein the increased clearance of the at least one print head from the first printing substrate web compensates for an increased thickness of the transition region.

9. A method to exchange printing substrate rolls in a printer, the method comprising:

printing, using at least one print head, ink to a first printing substrate web being unwound from a first printing substrate roll;

adjoining the first printing substrate web to a second printing substrate web being unwound from a second printing substrate roll to form a transition region to exchange the first printing substrate web with the second printing substrate web;

increasing a clearance of the at least one print head from the first printing substrate web before the transition region is transported past the at least one print head in a printing direction; and printing, using the at least one print head, a predetermined pattern to the transition region during the exchange of the first and the second printing substrate webs.

10. The method according to claim 9, wherein the predetermined pattern is chosen such that all nozzles of the at least one print head are operated to print the predetermined pattern.

11. The method according to claim 9, wherein the second printing substrate web is glued to the first printing substrate web to adjoin the first printing substrate web to a second printing substrate web.

12. The method according to claim 9, wherein printing during the exchange of the first printing substrate roll with the second printing substrate roll is continued with a same process speed as in the printing to the first printing substrate web before the exchange.

13. The method according to claim 9, wherein, during the exchange of the first printing substrate roll with the second printing substrate roll, the first and the second printing substrate webs are transported through the printer with a lower speed than a process speed at which the printing to the first printing substrate web before the exchange is performed.

14. The method according to claim 9, further comprising reducing the clearance of the at least one print head after the transition region is transported past the at least one print head in the printing direction.

15. The method according to claim 9, further comprising adjusting the position of the at least one print head to form a clearance between the at least one print head and the second printing substrate web after the transition region is transported past the at least one print head in the printing direction.

16. The method according to claim 15, wherein the clearance between the at least one print head and the second printing substrate web is equal to a distance between the at least one print head and the first printing substrate web before the increase of the clearance of the at least one print head from the first printing substrate web.

17. The method according to claim 9, wherein the printer comprises an autosplicer, and wherein the adjoining of the first printing substrate web to the second printing substrate web is performed by the autosplicer.

* * * * *